US007161572B2

(12) United States Patent
Takahashi et al.

(10) Patent No.: US 7,161,572 B2
(45) Date of Patent: Jan. 9, 2007

(54) LIQUID CRYSTAL DISPLAY DEVICE

(75) Inventors: Hiroyuki Takahashi, Funabashi (JP); Takayuki Iura, Mobara (JP)

(73) Assignee: Hitachi, Ltd., Tokyo (JP)

( * ) Notice: Subject to any disclaimer, the term of this patent is extended or adjusted under 35 U.S.C. 154(b) by 235 days.

(21) Appl. No.: 10/189,488

(22) Filed: Jul. 8, 2002

(65) Prior Publication Data

US 2003/0011551 A1 Jan. 16, 2003

(30) Foreign Application Priority Data

Jul. 16, 2001 (JP) ..... 2001-215535

(51) Int. Cl.
*G09G 3/36* (2006.01)
*G09G 3/20* (2006.01)

(52) U.S. Cl. ..... 345/94; 345/53

(58) Field of Classification Search ..... 345/87–106, 345/50–54, 204–215
See application file for complete search history.

(56) References Cited

U.S. PATENT DOCUMENTS 4,850,676 A * 7/1989 Yazaki et al. ..... 345/97
5,801,671 A * 9/1998 Kobayashi et al. ..... 345/95
5,886,679 A 3/1999 Matsuda et al.
6,300,930 B1 10/2001 Mori

FOREIGN PATENT DOCUMENTS

| | | |
|---|---|---|
| JP | 8-263013 | 10/1996 |
| JP | 09-212137 | 8/1997 |
| JP | 09-243998 | 9/1997 |
| JP | 11-326863 | 11/1999 |

* cited by examiner

*Primary Examiner*—Amare Mengistu
*Assistant Examiner*—Srilakshmi K Kumar
(74) *Attorney, Agent, or Firm*—Antonelli, Terry, Stout and Kraus, LLP.

(57) ABSTRACT

A liquid crystal display device comprising, a liquid crystal panel having parallel provision of a plurality of common electrodes COM extending in a first direction on one of a pair of substrates with a liquid crystal layer interposed therebetween and parallel provision of a plurality of segment electrodes SEG extending in a second direction crossing in the first direction on the other of the pair of substrates, a common driver for applying a scan signal(s) to the plurality of common electrodes COM, and a segment driver for applying to each of the plurality of segment electrodes SEG a pulse-width-modulated data signal voltage corresponding to display data, wherein the segment driver is operable upon switching of the pulse-width-modulated data signal voltage input to the segment electrode SEG to temporarily output to the segment electrode a voltage which is substantially equal to a non-select voltage of the common electrodes COM.

8 Claims, 8 Drawing Sheets

LIQUID CRYSTAL DISPLAY DEVICE

BACKGROUND OF THE INVENTION

1. Field of the Invention

The present invention relates to liquid crystal display devices and more particularly to a drive scheme of a liquid crystal display device with reduced drive power.

2. Description of the Related Art

In liquid crystal display devices using a liquid crystal panel of the STN scheme, a pixel drive signal thereof—that is, a drive signal for selection of each cell of the liquid crystal panel—consists essentially of a common signal that is a selected signal (scan signal) and a segment signal indicative of display data, wherein these are supplied in the form of alternate current (AC) signals.

FIG. 7 is a block diagram for explanation of an overall arrangement of drive circuitry of a liquid crystal display device. In this drawing, "LCD" is a liquid crystal panel, which is constituted from a plurality of common electrodes COM ($COM_1$, $COM_2$, . . . , $COM_n$, $COM_{n+1}$, . . . ) and a plurality of segment electrodes SEG ($SEG_1$, $SEG_2$, . . . , $SEG_m$, $SEG_{m+1}$, . . . ). A common driver D-C for driving the common electrodes COM is configured from a scan data generation circuit (scan signal generator circuit) DSS, a level shifter LS, a common-side liquid crystal drive circuit CD, and a DC/DC converter DD. The common-side liquid crystal drive circuit CD has a common voltage output circuit COP.

A segment driver D-S for driving the segment electrodes SEG is made up of an interface circuit (microcomputer interface) I/F of control signals and data (display data) input from an external signal source (a host computer or the like) and also of the power supply, a graphic RAM (GR), a gradation generator circuit GSL, and a segment-side liquid crystal drive circuit SDS. The segment-side liquid crystal drive circuit SDS has a segment voltage output circuit SOP. The DC/DC converter DD of common driver D-C generates from an externally input power supply voltage a power supply voltage(s) necessary for the common driver D-C and the segment driver D-S. A timing signal generated at the microcomputer interface I/F is utilized by the segment driver D-S and common driver D-C. At the microcomputer interface I/F, drive control signals such as a frame signal FLM and an AC-modified signal M plus a latch pulse(s) $CL_1$ and the like are generated based on a control signal input from the external signal source (host computer or else).

FIG. 8 is a waveform diagram for explanation of drive waveforms of the related art in case a segment level changes within a scan period in the scheme for applying a pulse-width-modulated data signal voltage to a segment electrode (referred to as the PWM scheme hereinafter). In the drawing, FLM designates a frame signal, M denotes an AC-modified signal, $CL_1$ is a latch pulse, COM ($COM_1$, $COM_2$, . . . , $COM_n$) is a common electrode drive signal, $SEG_j$ representatively indicates a segment electrode drive signal. Additionally, "($COM_n$)–($SEG_j$)" denotes an applied voltage of a cell (n, j).

A common electrode is applied a selected voltage VCH within a scan period and a non-select voltage VM in the remaining time periods. Accordingly the common electrode is mostly set at the non-select voltage VM. A segment output voltage to be applied to a segment electrode changes in accordance with a display pattern. With a gradation display due to the PWM scheme, at least a specified number—this number corresponds to a gradation level number—of tiny subdivided or "sliced" time periods are provided within a single selected period H (of each row), wherein a segment electrode output level is changed at an appropriate timing that is in conformity with the number of gradation levels being displayed.

In FIG. 8, the gradation number is set at 16 levels of from "1" (white) up to "16" (black), with the single selected period H being divided or sliced into 16 tiny subordinate periods-say, sub-periods. And, the common electrodes are sequentially applied a selected voltage VCH in an order from the first row thereof. In addition, a segment electrode $SEG_j$ in the j-th column is applied a level VSL corresponding to the white display as the segment electrode output for displaying the seventh level within 7 subperiods and also a level VSH corresponding to the black display for 9 subperiods. Note here that upon changing of the AC-modified signal M, the resultant correspondence relationship becomes reverse in such a way that the level corresponding to the white display is set at VSH whereas the level corresponding to the black display is at VSL.

Here, a voltage being applied between the segment electrode and common electrode at the cell (n, j) is given as "($COM_n$)–($SEG_j$)." Considering the case of n=3 which is an example of FIG. 8, the common electrode drive signal COMn at the n-th row is such that the selected voltage VCH is applied at a time of the n-th selected period whereas the non-select voltage VM is applied within the other periods. Although it becomes a non-select period at the cell (n, j) at a time of the first selected period, a voltage being applied between the segment electrode and common electrode at this cell becomes (VM–VSL) within the first 7 subperiods and becomes (VM–VSH) within the remaining 9 subperiods. Here, voltage setup is done to permit establishment of (VM–VSL)=(VSH–VM). Accordingly, at this cell, the voltage being applied between the segment electrode and common electrode changes from (VSH–VM) to (VM–VSH) upon switching of the voltage of the segment drive signal $SEG_j$ within a non-select period(s).

On the other hand, at a time of the n-th selected period, this cell becomes a selected period due to application of a selected voltage VCH to its common electrode, resulting in the voltage applied between the segment electrode and common electrode at this cell becoming (VCH–2VM+VSH) within an ON period 7/16 which is the initial white display and then becoming (VCH–VSH) within an OFF period 9/16 that is its subsequent black display.

FIG. 9 is a waveform diagram for explanation of another pattern of the related art drive waveforms. Here, an example is shown in case the AC-modified signal M was changed from the n-th selected period while displaying the white of gradation 1. Because the white of gradation 1 is being displayed, a segment drive signal $SEG_j$ is not yet changed along the way of a single selected period; however, as the AC-modified signal M is changing, the segment drive signal potentially changes from VSH to VSL from the n-th selected period. An application voltage at the cell (n, j) becomes (VCH–2VM+VSH) within the n-th selected period. At this time the applied voltage changes from (VSH–VM) to (VM–VSH) at a cell with the non-select voltage applied thereto such as a cell (1, j) by way of example, although not specifically depicted herein.

Here, electrical power consumption of the liquid crystal display device with the drive waveforms generates upon charge-up to the liquid crystal panel LCD. When the drive voltage of the segment electrode (segment drive voltage) changes, it changes into a state which permits accumulation or storage of electrical charge carriers of the same significance with opposite signs between it and an opposing common electrode applied by the non-select voltage. More specifically, certain ones wherein one of them is the charge of "+" whereas the other is the charge of "−" prior to a change of the segment drive voltage become the state in which one becomes the state of "−" and the other is of "+". At this time, half of a consumed current is used to set the charge between opposite electrodes in a zero state. In view of the fact that common electrodes applied by nor selected voltage are greater in number than common electrodes with the selected voltage applied thereto and that in the PWM scheme the segment drive voltage varies frequently, the power consumption in such a state change becomes noticeable. A current therefor is supplied from the power supply, which results in a bar to reduction of power consumption—this has been one of problems to be solved.

On the other hand, although several power consumption reduction techniques of the related art are taught from and suggested by JP-A-11-326863, JP-A-11-194314, JP-A-9-243998, JP-A-9-2121317 and JP-A-8-263013, these related art techniques are hardly directed to PWM-scheme liquid crystal display devices.

SUMMARY OF THE INVENTION

It is therefore an object of the invention to solve the above-described problems in PWM-scheme liquid crystal display devices to thereby provide a liquid crystal display device capable of being driven with low power consumption.

A principal characteristic of the invention resides in the matter that a segment electrode output voltage being applied to a segment electrode in order to establishment of short circuit of the segment electrode to a common electrode which is presently temporarily non-selected is for use as a non-select voltage of the common electrode. A description of one representative arrangement of the invention is as follows.

(1) A liquid crystal display device comprising a liquid crystal panel with parallel provision of a plurality of common electrodes extending in a first direction on one of a pair of substrates having a liquid crystal layer interposed therebetween and a plurality of segment electrodes extending in a second direction crossing the first direction on a remaining one of the pair of substrates, a common driver for application of a scan signal to the plurality of common electrodes, and a segment driver for applying to each of the plurality of segment electrodes a pulse-width-modulated data signal voltage corresponding to display data, wherein upon switching of the pulse-width-modulated data signal voltage being input to the segment electrode, the segment driver temporarily outputs to the segment electrode a voltage substantially equal to a non-select voltage of the common electrodes.

(2) The segment driver in (1), wherein the segment driver temporarily outputs to the common electrode a voltage substantially equal to the non-select voltage of the common electrodes upon switching of the pulse-width-modulated data signal voltage during a single selected period of the common electrode.

(3) A liquid crystal display device comprising a liquid crystal panel with parallel provision of a plurality of common electrodes extending in a first direction on one of a pair of substrates having a liquid crystal layer interposed therebetween and a plurality of segment electrodes extending in a second direction crossing the first direction on a remaining one of the pair of substrates, a common driver for application of a scan signal to the plurality of common electrodes, and a segment driver for applying to each of the plurality of segment electrodes a pulse-width-modulated data signal voltage corresponding to display data, wherein the segment driver has a circuit for temporarily causing the segment electrode and a non-select common electrode to be electrically shorted together upon switching of the pulse-width-modulated data signal voltage input to the segment electrode.

(4) The segment driver in (3), wherein the segment driver outputs to the segment electrode a voltage substantially equal to a non-select voltage of the common electrode during the short circuit.

(5) The segment driver in (3) or (4), wherein the segment driver performs the short circuit upon switching of the pulse-width-modulated data signal voltage during a single selected period of the common electrode.

More practically, the gradation number is divided into small sub-periods while letting a single subperiod between time periods for selection of different levels be set at a common non-select voltage level to thereby discharge electrical charge between electrodes of a liquid crystal panel within a single subperiod of this common non-select voltage level without any current supply from the outside.

It is noted here that the invention should not be limited only to the above arrangement and the arrangement of more than one embodiment as will be described later, and it is needless to say that a variety of modifications and alternations are possible without departing from the technical idea of this invention.

DESCRIPTION OF THE PREFERRED EMBODIMENTS

An illustrative embodiment(s) of the invention will now be explained in detail with reference to the accompanying drawings below.

Figure 1:
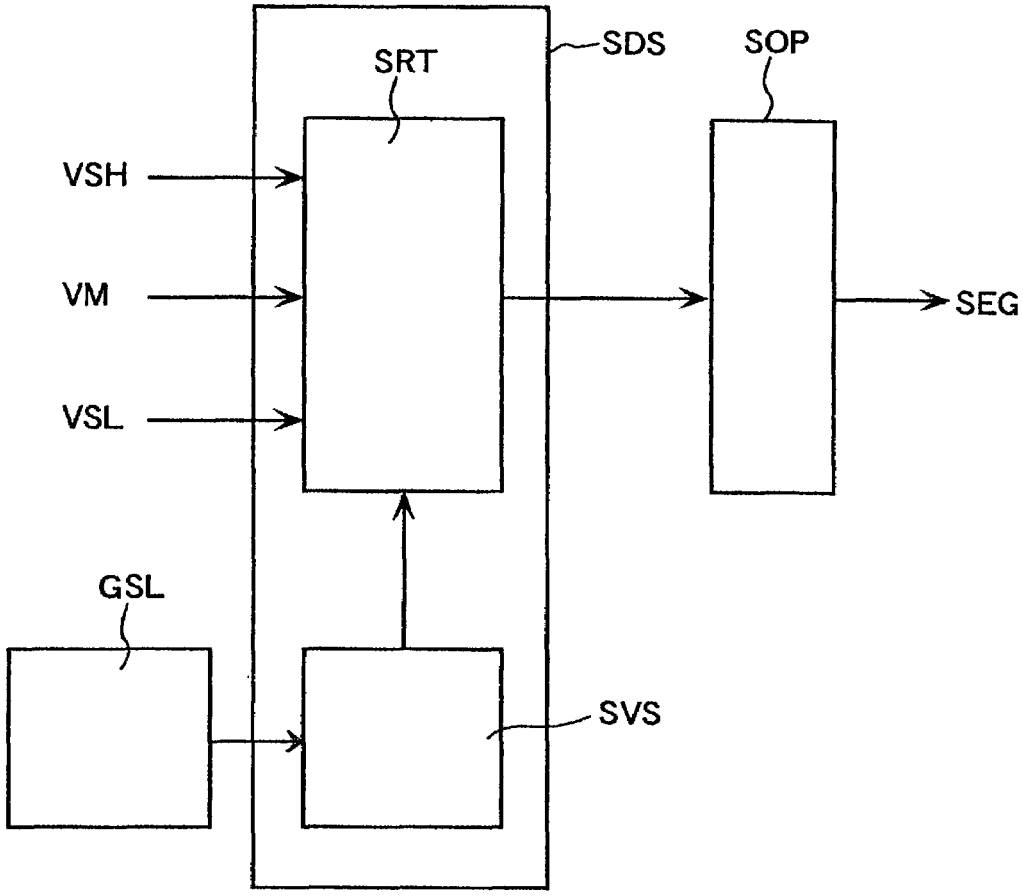
FIG. 1 is a block diagram showing a configuration of a main part of a liquid crystal drive circuit for explanation of one embodiment of the invention.

FIG. 1 is a block diagram showing a configuration of main part of a liquid crystal drive circuit for explanation of one embodiment of the invention. In addition, FIG. 2 is an explanation diagram of drive waveforms in one embodiment of this invention.

Figure 7:
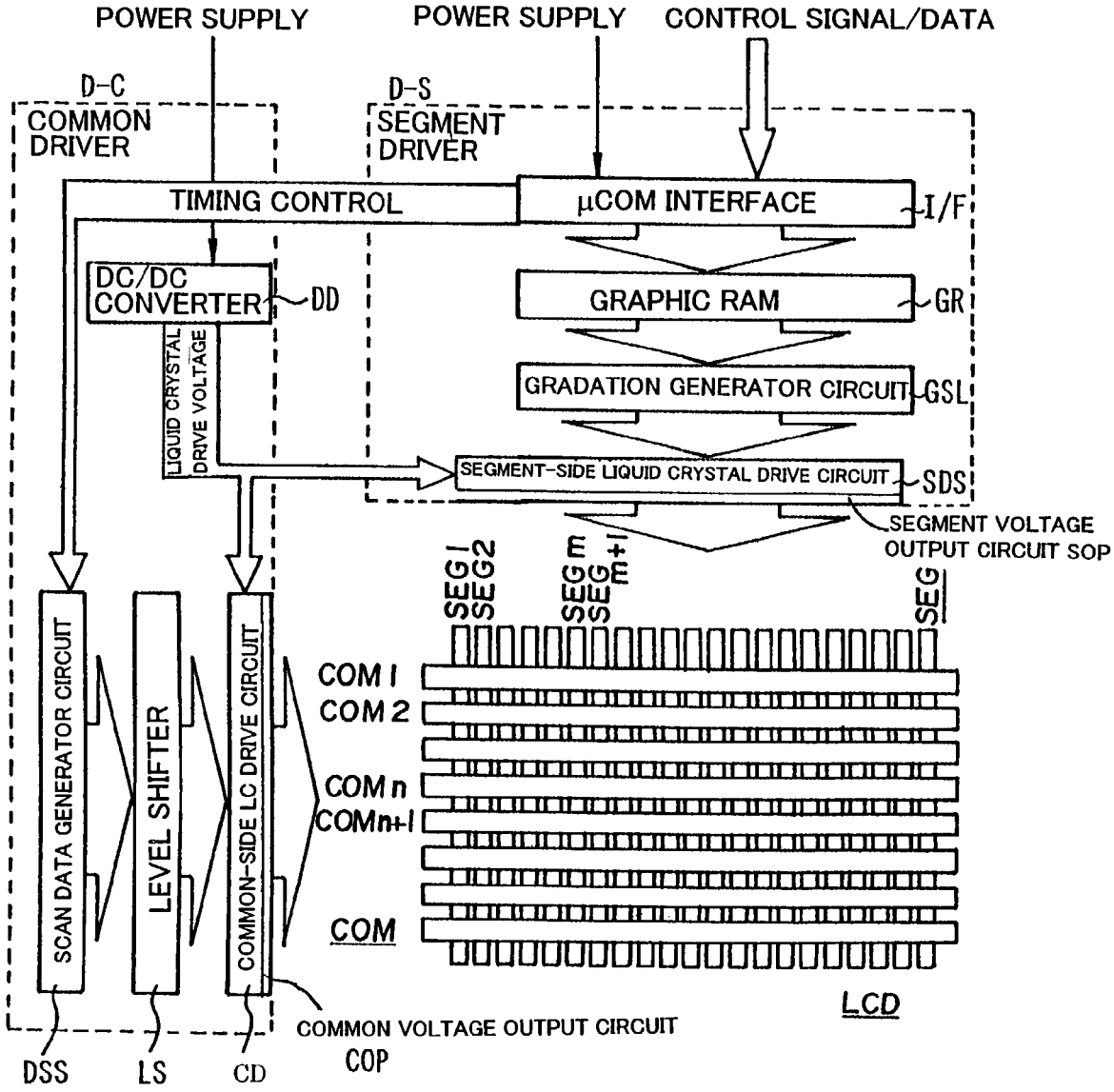
FIG. 7 is a block diagram for explanation of an overall configuration of a drive circuit of the liquid crystal display device.

In FIG. 1, in this embodiment, the segment driver D-S of the liquid crystal drive circuit as has been explained in conjunction with FIG. 7 is equipped with a selected period data signal voltage changeover/switching detection circuit SVS and an electrical short circuit SRT. The selected period data signal voltage switch detection circuit SVS inputs an output signal of a gradation generation circuit GSL and detects a changeover of a pulse-width-modulated data signal voltage within a single selected time period of a common electrode or alternatively at a switching time point to the next selected period. Segment voltages VSH and VSL and a common electrode voltage VM are input to the short circuit SRT. Based on the detection of the selected period data signal voltage switch detection circuit SVS, the short circuit SRT electrically short circuits the segment electrode to a non-selected common electrode together at a time point of changeover of such data signal voltage.

Figure 2:
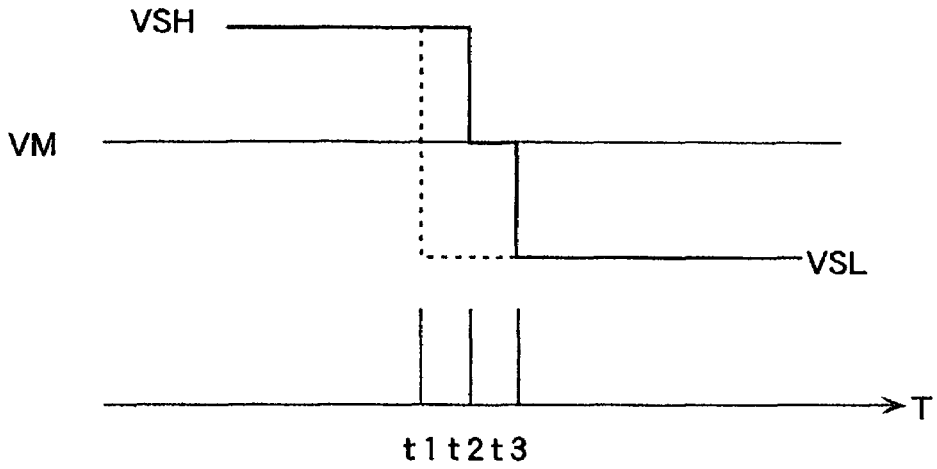
FIG. 2 is an explanation diagram of waveforms in one embodiment of the invention.

As shown in FIG. 2, the segment voltage VSH is at a high level (+) with respect to the common electrode non-select voltage VM; similarly, VSL is at a low level (−). When the selected period data signal voltage switch detection circuit SVS detects a data signal voltage change at a time point $t_1$, let the potential of a segment electrode be set at the common electrode non-select voltage VM at a time point $t_2$ after elapse of one "small" subperiod. At a time point $t_3$ after elapse of a further one subperiod, It is connected to VSL. Between this $t_2$ and $t_3$, there is established a state in which electrical short is done between the segment electrode and the non-select common electrode, causing electrical charge to discharge. Any one of VM, VSH and VSL is output as a signal SEG to the output of a segment voltage output circuit SOP. Note that although the expression "short" was used herein, the segment electrode and the common electrode need not always be the same in potential and may be substantially the same —this will also be included in what is called the "short" here. Accordingly, it is permissible to apply to the segment electrode voltage almost equal to the non-select voltage VM of the common electrode(s).

Figure 3:
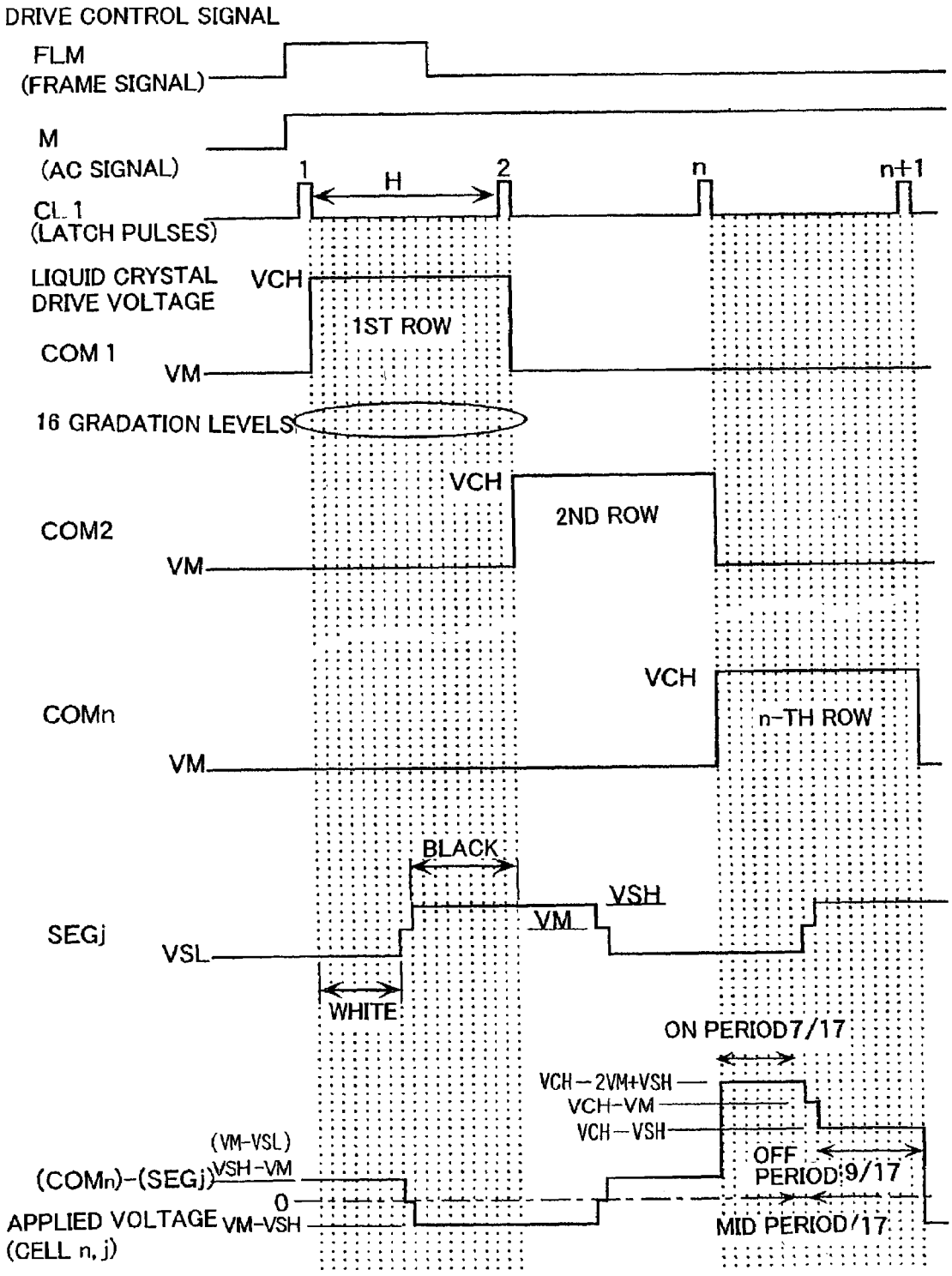
FIG. 3 is a drive waveform diagram for explanation of an embodiment when a gradation level changes within a single scan period in this invention with a gradation number of display data being set at 16.
Figure 8:
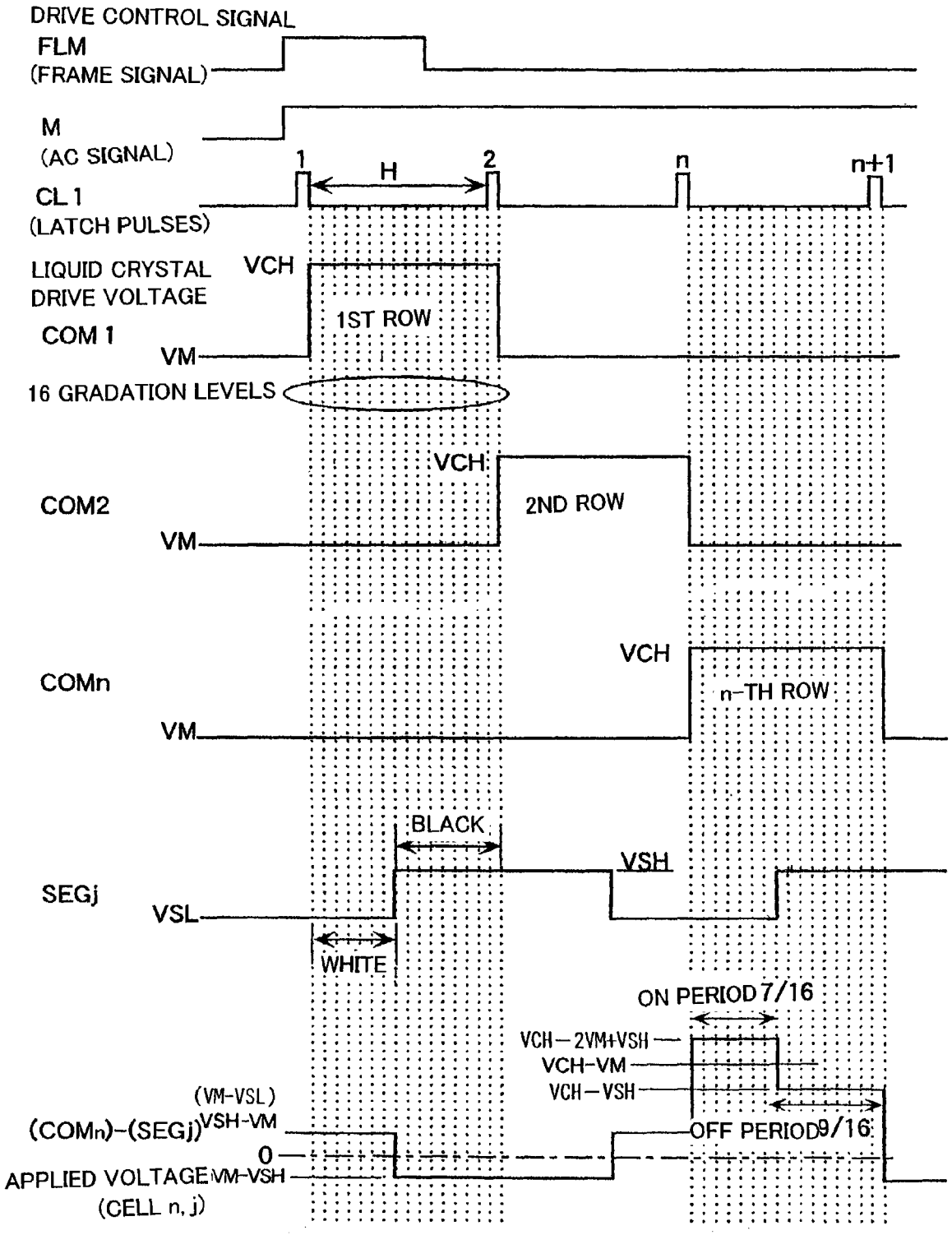
FIG. 8 is a waveform diagram for explanation of one related art example of drive waveforms in the event that a segment level changes within a scan period in a scheme (PWM scheme) for applying a pulse-width-modulated data signal voltage to a segment electrode.
Figure 9:
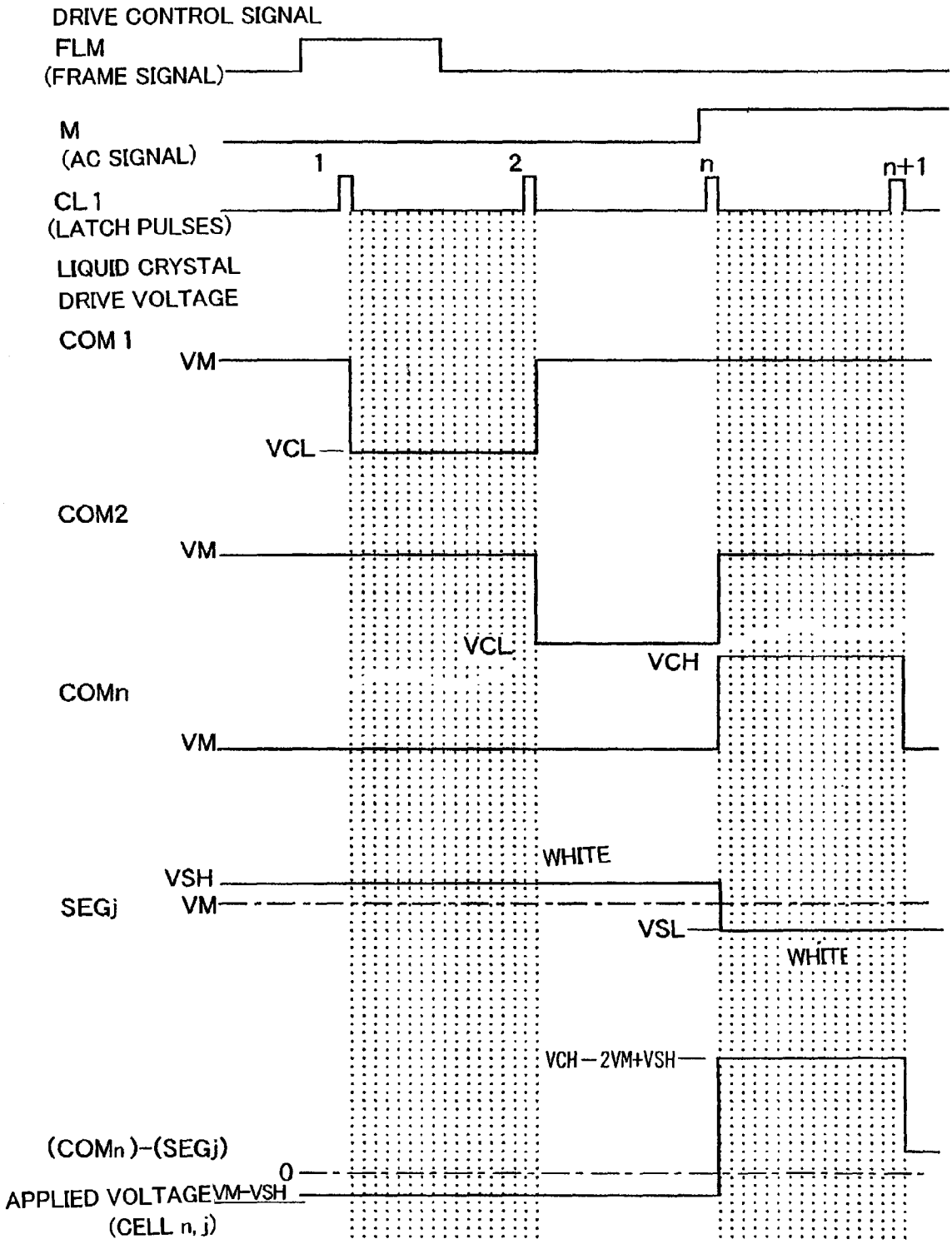
FIG. 9 is a waveform diagram for explanation of another related art of drive waveforms.

FIG. 3 is a drive waveform diagram for explanation of an embodiment when the gradation level varies or changes within a single scan period in this invention with a gradation number of display data set at sixteen (16). The same reference characters as those of FIG. 8 correspond to the same waveform portions. In order to display the 16 gradation levels of from 1 (white) to 16 (black), the display data applied to the segment electrode is such that a single selected period is subdivided into seventeen (17) small sub-periods. And, in order to display the seventh gradation level at a cell (n, j) for example, a level corresponding to white display as a segment electrode output is set at 7 subperiods; a level corresponding to black display is set at 9 subperiods; and, one subperiod between these different level selected periods is set at a common electrode non-select level.

A common electrode non-selected is such that a voltage which is applied between the segment electrode and common electrode is (VSH−VM) at white display portions and VM−VSH at black display portions. As shown in FIG. 3, in the event that the level changes within a single scan period, the potential of a segment electrode is short-circuited to the common electrode non-select voltage VM within a single subperiod as explained in FIG. 2. Electrical charge between the both electrodes is discharged during this shorting. As the non-selected voltage is applied to most of common electrodes, extra-low power consumption is achievable.

On the other hand, a voltage applied between a segment electrode and a common electrode as set at a select level measures (VCH−2VM+VSH) within a turn-on sub period 7/17 and stays at (VCH−VSH) within a turn-off period and temporarily becomes (CVH−VM) upon switching of it.

The invention may similarly be applied to cases where the segment voltage does not vary along the way such as during white-paint displaying. This is because a change in AC-modified signal M results in the segment voltage change. In this case, the selected period data signal voltage switching detection circuit SVS of FIG. 1 detects switching or changeover of the next selected period data signal voltage.

Figure 4:
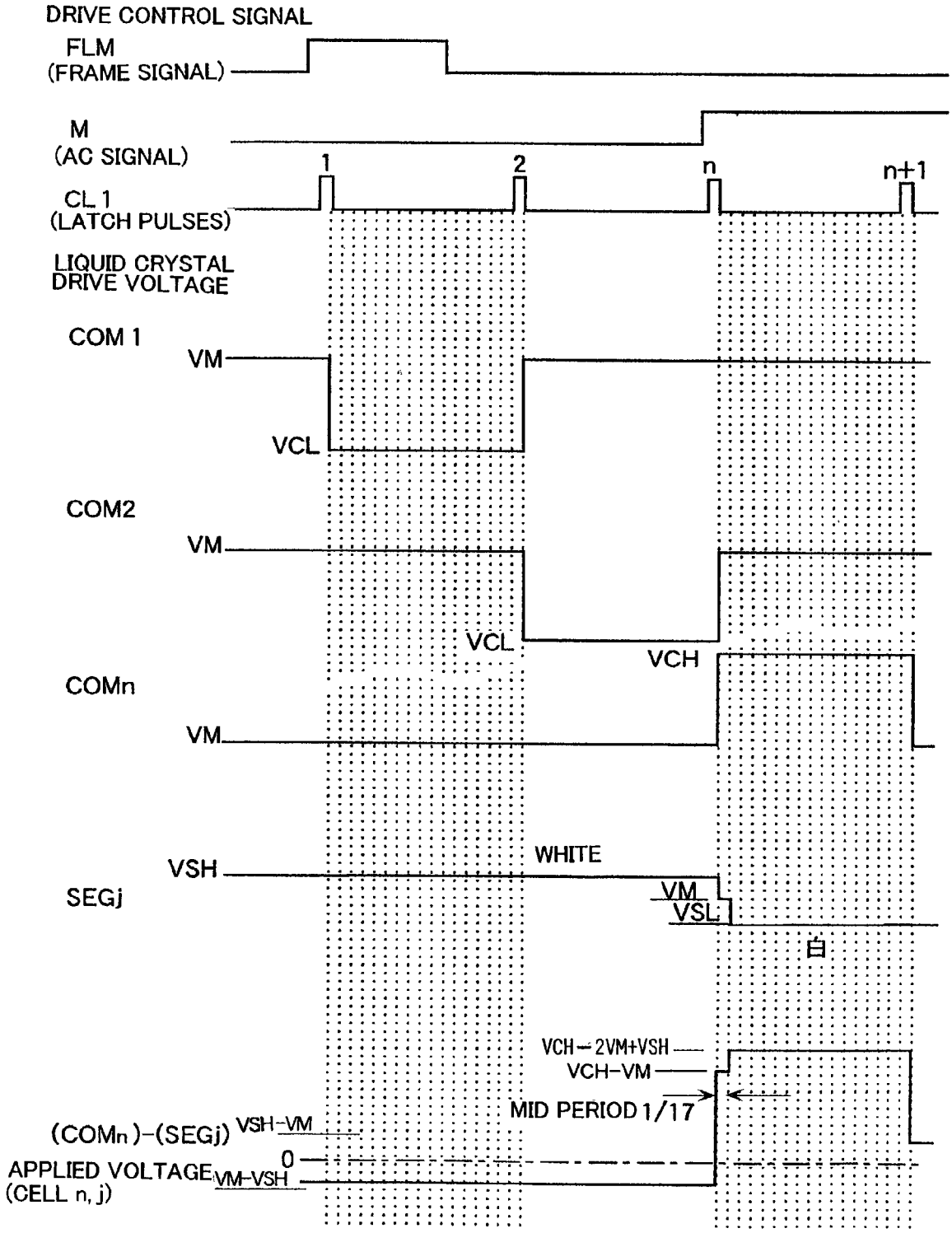
FIG. 4 is a drive waveform diagram for explanation of an embodiment when the gradation level changes between a scan period and its subsequent scan period in the invention with the gradation number of display data set at 16.

FIG. 4 is a drive waveform diagram for explanation of an embodiment when the gradation level changes between a scan period and the next scan period in the invention with the gradation number of display data set at 16. The same reference characters as those of FIG. 3 correspond to the same waveform portions. This drive waveform is such that the AC-modified signal M has changed at the n-th one of latch pulses $CL_1$. FIG. 4, there are shown waveforms in the event of the so-called white paint display, for performing white display in the entire area of a display screen. Here, a voltage to be applied to a segment electrode changes from VSH to VSL at a boundary of scan periods for alternate current (AC) modification or transformation. Within the initial subperiod (1/17) at this change time point, let the segment electrode is temporarily short-circuited to a common electrode resulting in establishment of the non-select voltage VM of common electrode voltage, followed by application of VSL at the beginning of its subsequent subperiod.

Consequently, at a non-selected cell(s), not shown, the voltage between a segment electrode and common electrode becomes zero (0) within the subperiod 1/17, causing charge between the both electrodes to discharge during this. In this way, low power consumption is achieved by discharging charge between electrodes of liquid crystal pulses without any external current supply.

Although in each embodiment stated above a single select period is divided into 17 sub-periods with a single gradation level added to 16 gradation levels, the invention is not limited to this. In summary, for gradation display in the PWM scheme, a single select period may be divided into small sub-periods greater than or equal in number to at least the gradation number (gradation level number) with at least one subperiod added thereto while letting a segment electrode voltage of this subperiod be set at the non-select voltage level of common electrodes at a time point of its changing to a different segment voltage level.

As the timing at which this segment electrode voltage changes, there will be a case where the segment voltage varies upon switching of a select period due to a change of the AC-modified signal M or a case where the AC signal M is kept unchanged whereas the segment voltage changes along the way of a single select period in the case of displaying an intermediate gradation by the PWM scheme or the like. At this time, a voltage which is substantially equal to the non-select voltage VM of common electrode may be temporarily output with respect to the segment electrode.

In the way as stated above, according to the invention, it is possible to lessen power dissipation of the liquid crystal display device, which in turn makes it possible to increase its waiting/standby time period in cases where this liquid crystal display device is used as the display unit of a mobile telephone handsets as an example. Alternatively, with the ones that have the same standby time as the related art, portable telephones may be reduced in weight.

In terms of application examples of the instant invention, preparing a liquid crystal driver capable of selecting several types of changeover timings makes it possible to rapidly realize optimal drive conditions even where physical property values of liquid crystal material constituting the liquid crystal panel and/or resistance values of transparent electrodes are changed. Additionally, the invention is capable of obtaining similar effects to the above-noted ones even when applied to liquid crystal display devices of the type employing the so-called multiple-line drive schemes.

An explanation will next be given of an outer appearance example of a liquid crystal display device for use in mobile telephone handsets as an example of the liquid crystal display device to which the invention is applied.

Figure 5:
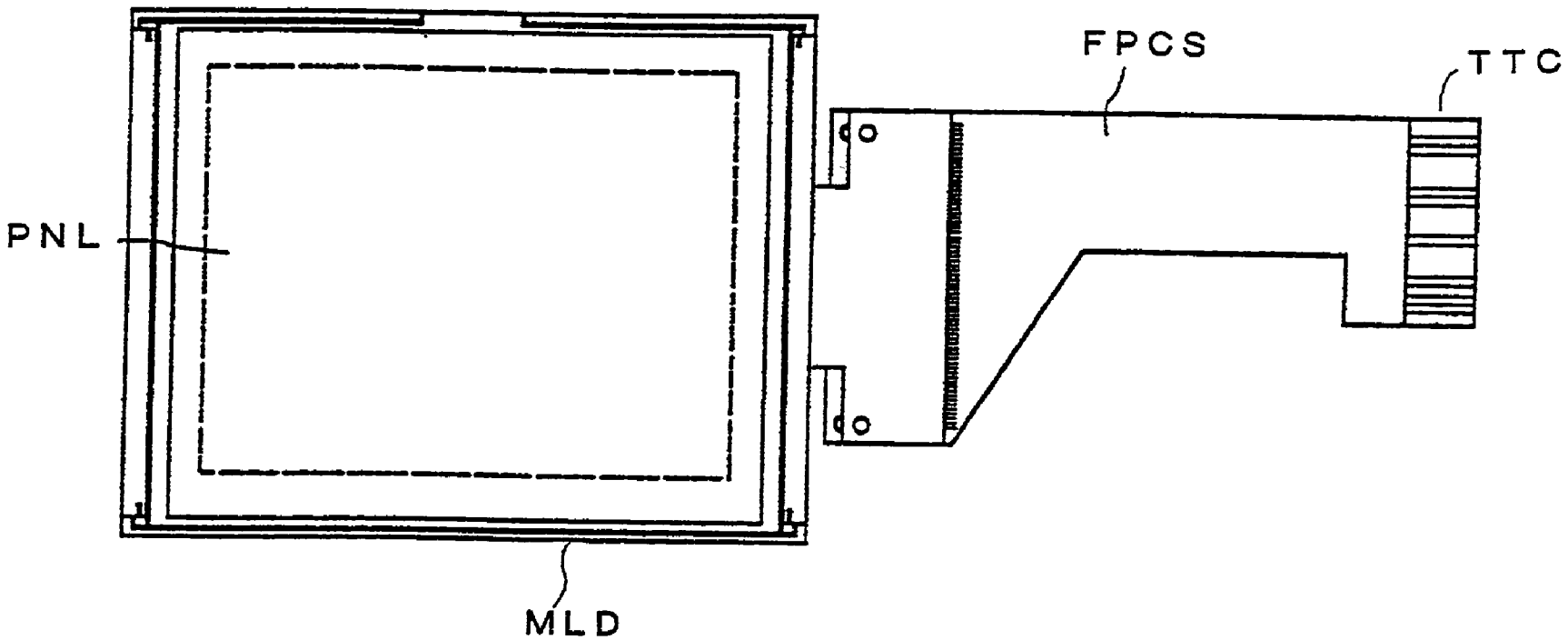
FIG. 5 is a plan view diagram of a liquid crystal display device for portable telephone handsets in accordance with the invention.
Figure 6:
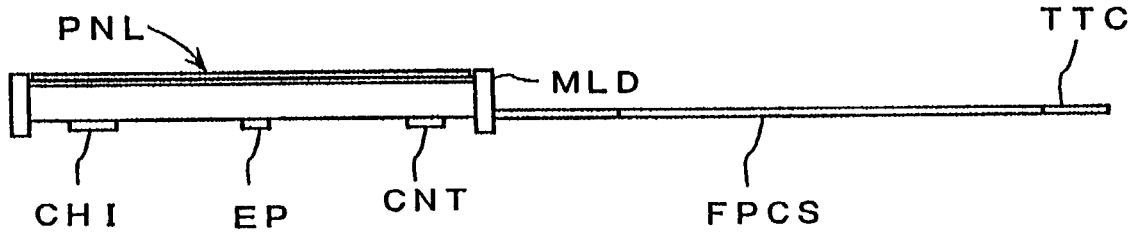
FIG. 6 is a side view diagram of the liquid crystal display device for mobile telephone handsets shown in FIG. 5.

FIG. 5 is a plan view diagram of a liquid crystal display device for mobile telephone handsets in accordance with the invention; FIG. 6 is a side view diagram of it. The liquid crystal display device is received in a housing (mold) MLD, wherein its liquid crystal panel PNL is exposed to a surface as a display screen. Display data to this liquid crystal display device and the power supply required for drive operations are supplied from a host computer, not shown, through a flexible printed circuit board FPCS. Reference character "TTC" designates a terminal section for connection to a connector on the host computer side.

The flexible printed circuit board FPCS is connected to a connector CNT which is provided on a printed circuit board as disposed on the back surface of the liquid crystal display device. Mounted on this printed circuit board are more than one driver IC for constitution of a segment driver and a common driver having the common voltage output unit and a variety of types of components EP. Using this liquid crystal display device makes it possible to realize low power consumption of portable telephone handsets.

As has been explained above, according to the invention, letting a segment electrode be short-circuited to a non-select common electrode at a time point whereat a segment voltage changes makes it possible to suppress an increase in power consumption in the PWM scheme and also possible to lengthen an operable time period of portable telephone handsets and/or mobile information terminals or the like which are less in battery capacities while enabling provision of a liquid crystal display device capable of lightening equipments in the case of the same waiting/standby time length of the same capacity.

What is claimed is:

1. A liquid crystal display device comprising:

a liquid crystal panel with parallel provision of a plurality of common electrodes extending in a first direction on one of a pair of substrates having a liquid crystal layer interposed therebetween and a plurality of segment electrodes extending in a second direction crossing the first direction on a remaining one of the pair of substrates;

a common driver for application of a scan signal to the plurality of common electrodes; and a segment driver for applying to each of the plurality of segment electrodes a pulse-width-modulated data signal voltage corresponding to display data, wherein, upon every timing of both a first timing when a signal voltage input to the segment electrode changes a smaller voltage into a larger voltage than a non-select voltage of the common electrode and a second timing when a signal voltage input to the segment electrode changes a larger voltage into a smaller voltage than the non-select voltage of the common electrode, the segment driver outputs and holds, to the segment electrode, a voltage substantially equal to the non-select voltage of the common electrode for a prescribed period of time.

2. The liquid crystal display device according to claim 1, wherein one of the first timing and the second timing occurs during a single select period of the common electrode.

3. A liquid crystal display device comprising:

a liquid crystal panel with parallel provision of a plurality of common electrodes extending in a first direction on one of a pair of substrates having a liquid crystal layer interposed therebetween and a plurality of segment electrodes extending in a second direction crossing the first direction on a remaining one of the pair of substrates;

a common driver for application of a scan signal to the plurality of common electrodes; and a segment driver for applying to each of the plurality of segment electrodes a pulse-width-modulated data signal voltage corresponding to display data, wherein the segment driver has a circuit for causing the segment electrode and a non-select common electrode to be short-circuited for a prescribed period of time, upon every timing of both a first timing when a signal voltage input to the segment electrode changes a smaller voltage into a larger voltage than a non-select voltage of the common electrode and a second timing when a signal voltage input to the segment electrode changes a larger voltage into a smaller voltage than the non-select voltage of the common electrode.

4. The liquid crystal display device according to claim 3, wherein the segment driver outputs to the segment electrode a voltage substantially equal to a non-selected voltage of the common electrode during the short circuit.

5. The liquid crystal display device according to claim 3, wherein the segment driver performs the short circuit upon one of the first timing and the second timing during a single selected period of the common electrode.

6. The liquid crystal display device according to claim 4, wherein the segment driver performs the short circuit upon one of the first timing and the second timing during a single selected period of the common electrode.

7. A display device comprising:

a display panel having a plurality of common electrodes extending in a first direction on one of a pair of substrates and a plurality of segment electrodes extending in a second direction crossing the first direction on a remaining one of the pair of substrates;

a common driver for applying a scan signal to the plurality of common electrodes; and a segment driver for applying to each of the plurality of segment electrodes a pulse-width-modulated data signal voltage corresponding to display data, wherein upon every timing of both a first timing when a signal voltage input to the segment electrode changes a smaller voltage into a larger voltage than a non-select voltage of the common electrode and a second timing when a signal voltage input to the segment electrode changes a larger voltage into a smaller voltage than the non-select voltage of the common electrode, the segment driver outputs and holds, to the segment electrode, a voltage substantially equal to the non-select voltage of the common electrode for a prescribed period of time.

8. The display device according to claim 7, wherein one of the first timing and the second timing occurs during a single select period of the common electrode.

* * * * *